US008979598B2

(12) United States Patent
Liao

(10) Patent No.: US 8,979,598 B2
(45) Date of Patent: Mar. 17, 2015

(54) ASSEMBLED CONNECTING DEVICE WITH A PROTECTIVE SLEEVE

(71) Applicant: Sheng-Hsin Liao, New Taipei (TW)

(72) Inventor: Sheng-Hsin Liao, New Taipei (TW)

( * ) Notice: Subject to any disclaimer, the term of this patent is extended or adjusted under 35 U.S.C. 154(b) by 139 days.

(21) Appl. No.: 13/757,769

(22) Filed: Feb. 2, 2013

(65) Prior Publication Data

US 2014/0170909 A1 Jun. 19, 2014

(30) Foreign Application Priority Data

Dec. 14, 2012 (TW) ..... 101147537 A

(51) Int. Cl.
*H01R 4/18* (2006.01)
*H01R 13/447* (2006.01)
*H01R 31/06* (2006.01)

(52) U.S. Cl.
CPC ..... *H01R 13/447* (2013.01); *H01R 31/06* (2013.01)
USPC ..... 439/730

(58) Field of Classification Search
USPC ..... 439/730, 350, 131, 76.1, 257–258, 372, 439/352
See application file for complete search history.

(56) References Cited

U.S. PATENT DOCUMENTS

| | | | | |
|---|---|---|---|---|
| 5,395,266 | A * | 3/1995 | Abe et al. | 439/587 |
| 6,999,322 | B1 * | 2/2006 | Lin | 361/752 |
| 7,077,686 | B2 * | 7/2006 | Seo et al. | 439/372 |
| 7,422,457 | B1 * | 9/2008 | Wu | 439/258 |
| 7,628,622 | B2 * | 12/2009 | Yu et al. | 439/131 |
| 7,901,235 | B2 * | 3/2011 | Gordon et al. | 439/350 |
| 8,668,515 | B2 * | 3/2014 | Wu | 439/352 |
| 8,764,471 | B2 * | 7/2014 | Dang | 439/310 |
| 2008/0232060 | A1 * | 9/2008 | Yu et al. | 361/684 |

* cited by examiner

*Primary Examiner* — Jean F Duverne
(74) *Attorney, Agent, or Firm* — Li & Cai Intellectual Property (USA) Office

(57) ABSTRACT

An assembled connecting device with a protective sleeve includes a first connector and a protective sleeve. The first connector has a plugging portion. The protective sleeve is movably coupled to the first connector and has a sheath. The sheath of the protective sleeve is selectively sleeves the first connector.

16 Claims, 13 Drawing Sheets

ASSEMBLED CONNECTING DEVICE WITH A PROTECTIVE SLEEVE

BACKGROUND OF THE INVENTION

1. Field of the Invention

The present disclosure relates to an assembled connecting device with a protective sleeve; in particular, to a connecting device providing better protection.

2. Description of Related Art

Conventional connecting devices are connection elements and their supplemental accessories used on electronic signaling and electric power, mainly for facilitating accurate transmission of signals between different products. Conventional connecting devices are of many different types and structures, and can be applied on computers, peripheral devices for computers, industrial devices, telecommunication and communication, automobile, transportation, domestic appliance, medical equipment, etc.

Most conventional connecting devices each have an insulation main body and a plurality of endpoints disposed on the insulation main body. When the connecting device is not in use, the insulation main body and the a plurality of endpoints are exposed, vulnerable to scratching and damage. Additionally, an exposed insulation main body and endpoints are likely to catch other objects, thereby damaging said other objects or the connecting device itself.

SUMMARY OF THE INVENTION

The object of the present invention is to provide an assembled connecting device with a protective sleeve for preventing a connector from being damaged or damaging other objects.

In order to achieve the aforementioned object, according to an embodiment of the present invention, the present disclosure provides an assembled connecting device with a protective sleeve, including: a first connector having a plugging portion, and a protective sleeve having a sheath. The protective sleeve is movably coupled to the first connector. The sheath of the protective sleeve selectively sleeves the first connector.

The present disclosure further provides an assembled connecting device with a protective sleeve, including: an adapter having two connectors electrically connected to each other, and a protective sleeve having a sheath. The protective sleeve is movably coupled to the adapter. The sheath of the protective sleeve selectively sleeves the adapter.

The protective sleeve of the present disclosure is movably coupled to the first connector. The sheath of the protective sleeve selectively sleeves the first connector, for preventing the plugging portion of the first connector from being damaged or damaging other objects.

In order to further the understanding regarding the present invention, the following embodiments are provided along with illustrations to facilitate the disclosure of the present invention.

DETAILED DESCRIPTION OF THE PREFERRED EMBODIMENTS

The aforementioned illustrations and following detailed descriptions are exemplary for the purpose of further explaining the scope of the present invention. Other objectives and advantages related to the present invention will be illustrated in the subsequent descriptions and appended drawings.

First Embodiment

Figure 1:
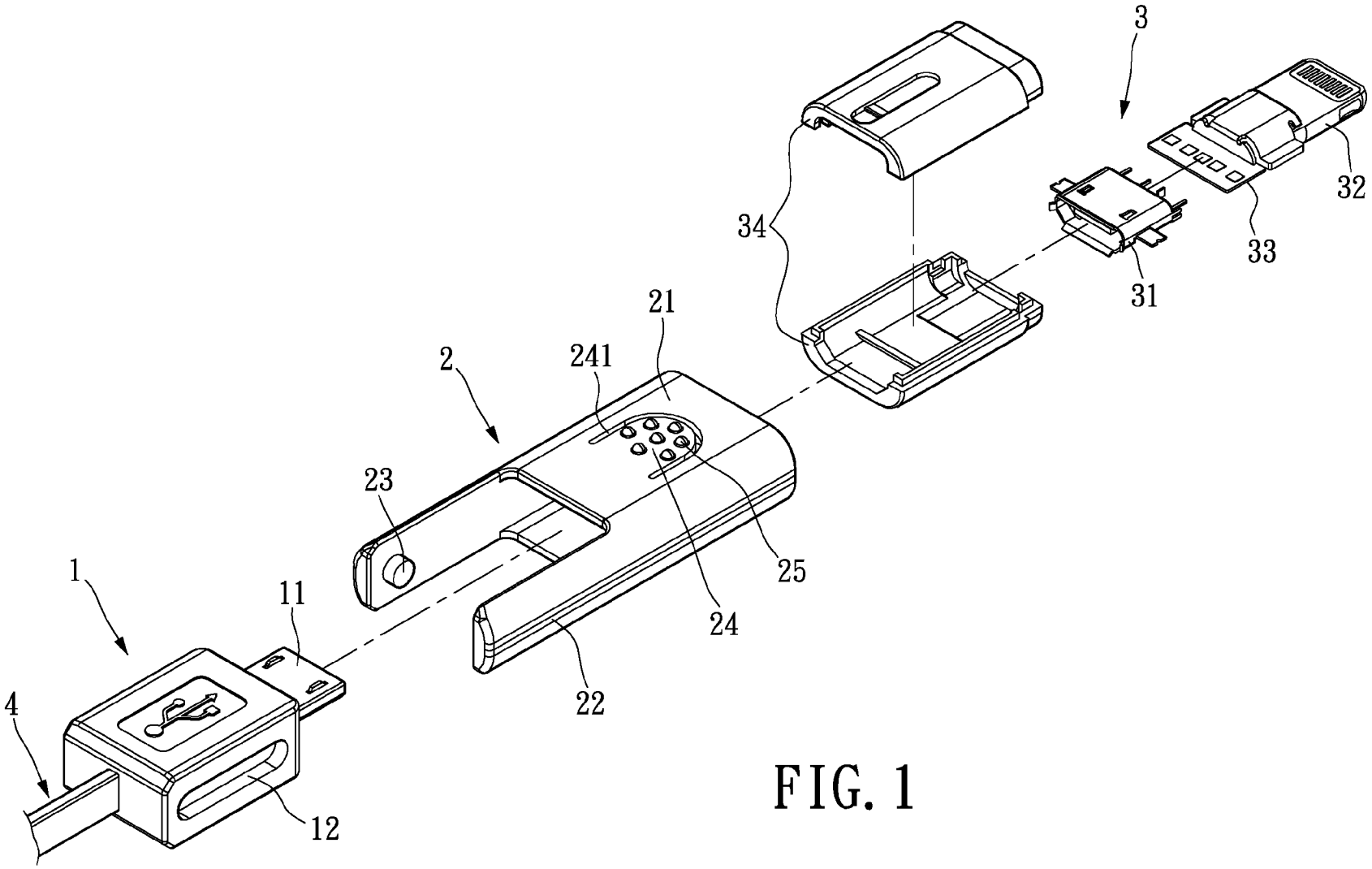
FIG. 1 shows a perspective exploded diagram of a first embodiment of a connecting device of the present disclosure.
Figure 2:
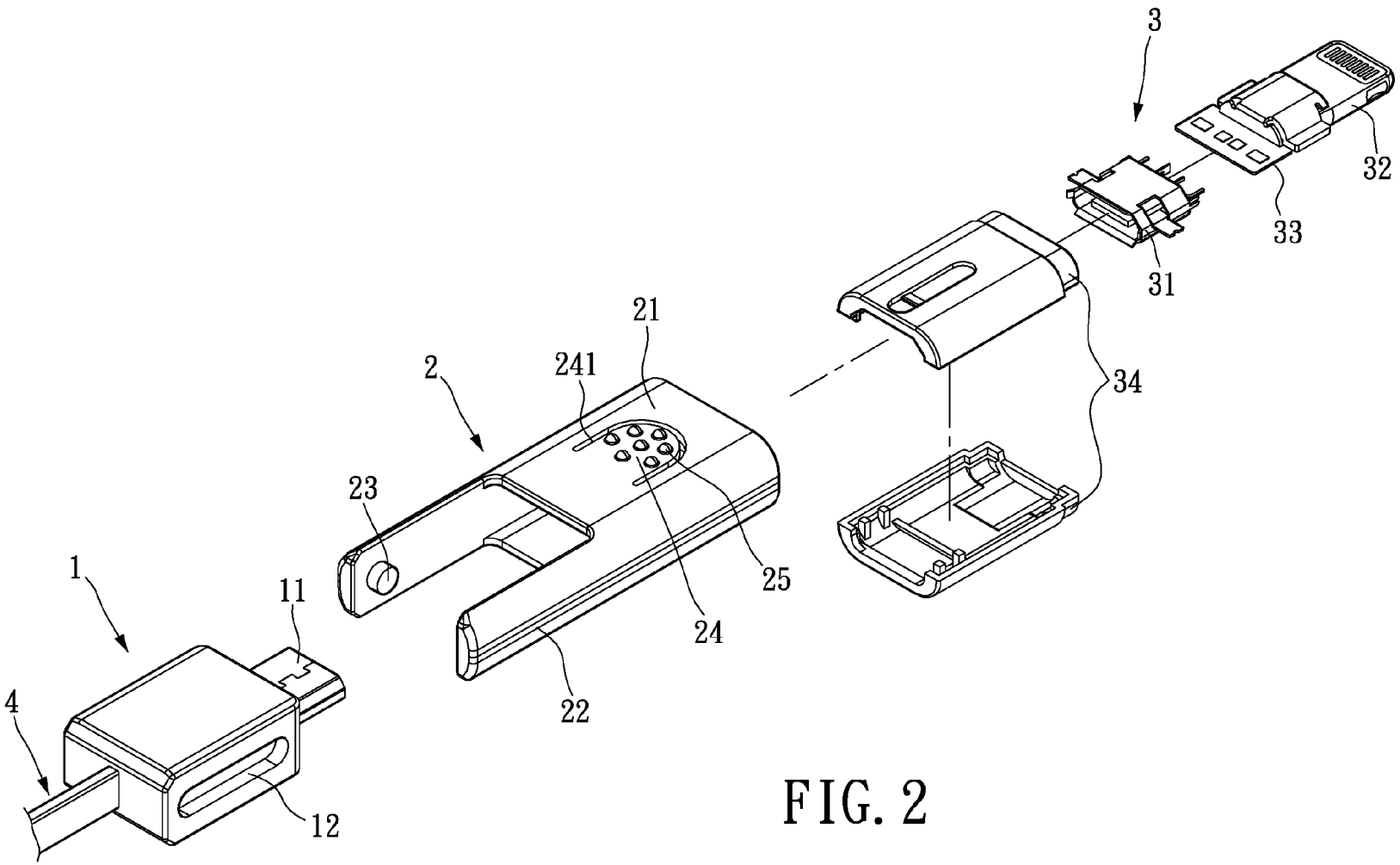
FIG. 2 shows another perspective exploded diagram of a first embodiment of a connecting device of the present disclosure.
Figure 3:
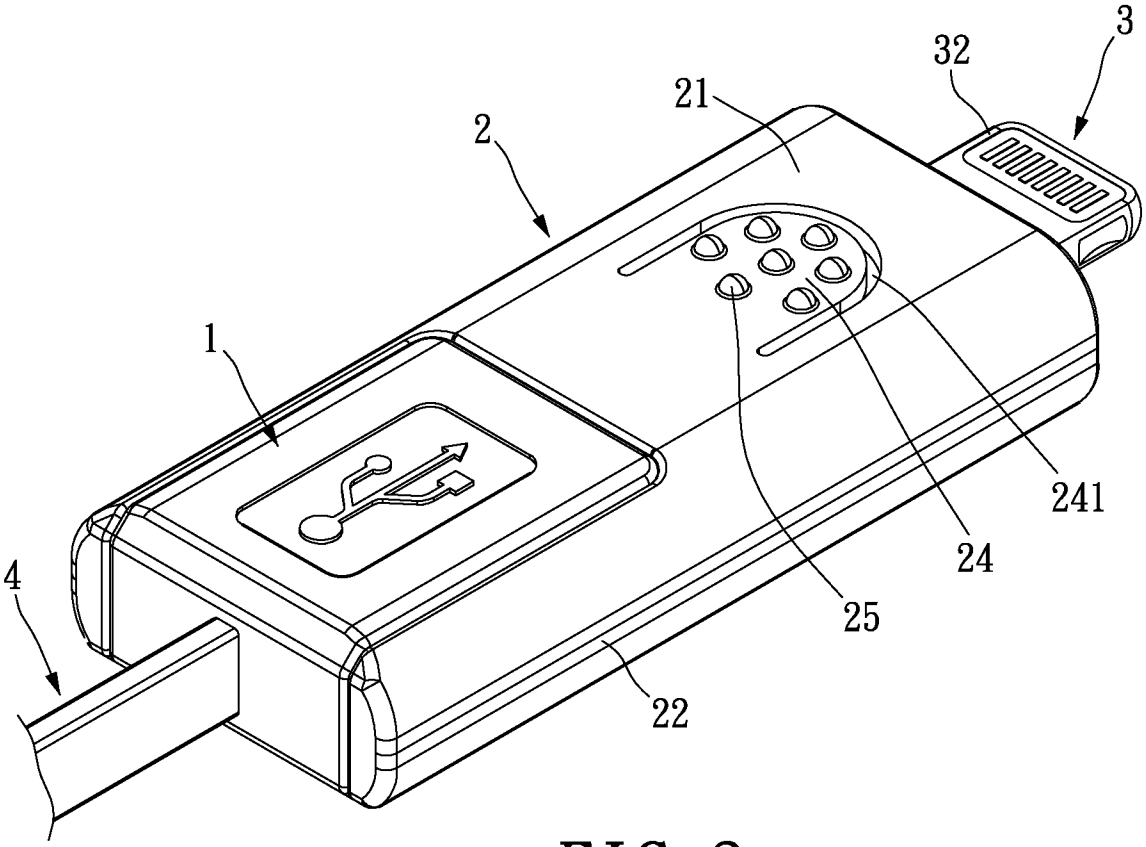
FIG. 3 shows a perspective diagram of a first embodiment of a connecting device of the present disclosure.

Referring to FIG. 1 to FIG. 3, the present disclosure provides an assembled connecting device with a protective sleeve including a first connector 1 and a protective sleeve 2. The type and structure of the first connector 1 is not limited. The first connector 1 can be an USB connector, an IEEE1394 connector, an HDMI connector, a display port connector, an RJ connector, an AV terminal, a DC terminal, an iphone connector, or other types of connectors. The first connector 1 can be electrically connected to a cable 4 or other devices. The cable 4 can be flat, round, or a shape not limited herein. The structure of connector 1 is conventional knowledge and therefore is not further described here.

The protective sleeve 2 can be made of plastic, metal or a material not limited herein. The protective sleeve 2 has a hollow sheath 21. The protective sleeve 2 can be movably coupled to the first connector 1. The sheath 21 of the protective sleeve 2 selectively sleeves the first connector 1. Namely, the sheath 21 of the protective sleeve 2 can be selected to sleeve at least a partial region of the first connector 1 (such as a plugging portion 11). The sheath 21 of the protective sleeve 2 can also be selected to not sleeve the first connector 1.

The shape and structure of the protective sleeve 2 are not limited, and can be modified according to the shape and structure of the first connector 1. In the present embodiment, the sheath 21 roughly forms a rectangular-prism for receiving the plugging portion 11 of the first connector 1. The dimensions of the sheath 21 are bigger than the dimensions of the plugging portion 11. Namely, the height, width and length of the sheath 21 are respectively bigger than the height, width and length of the plugging portion 11, such that the plugging portion 11 can be selectively accommodated within the sheath 21, and an appropriate gap is formed between the plugging portion 11 and the sheath 21.

In the present embodiment, the protective sleeve 2 has two link arms 22 extending from two sides of the sheath 21. The link arms 22 can be fixedly or pivotally connected to the sheath 21. The two link arms 22 and the sheath 21 of the present embodiment are a single integrated body. Pivot parts 23 are formed respectively on the interior sides of the link arms 22. The pivot part 23 can be a pivot structure, etc. Corresponding sliding grooves 12 are disposed on two sides of the first connector 1. The pivot parts 23 of the protective sleeve 2 and the sliding grooves 12 of the first connector 1 slidably work in concert such that the protective sleeve 2 can be movably coupled to the first connector 1. The first connector 1 can move and rotate in different directions between the two link arms 22 by the sliding of the pivot parts 23 of the protective sleeve 2 within the sliding grooves 12 of the first connector 1.

Figure 13:
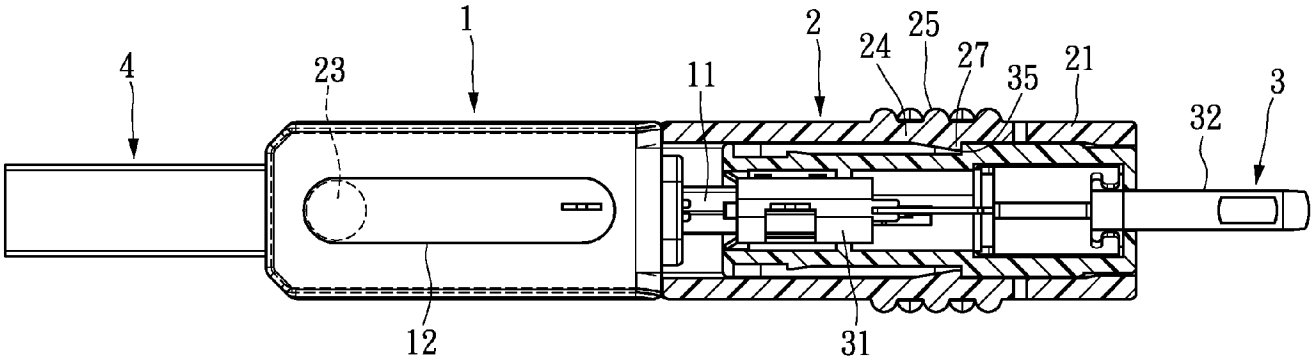
FIG. 13 shows a cross-sectional diagram (1) of a first embodiment of a connecting device of the present disclosure.
Figure 14:
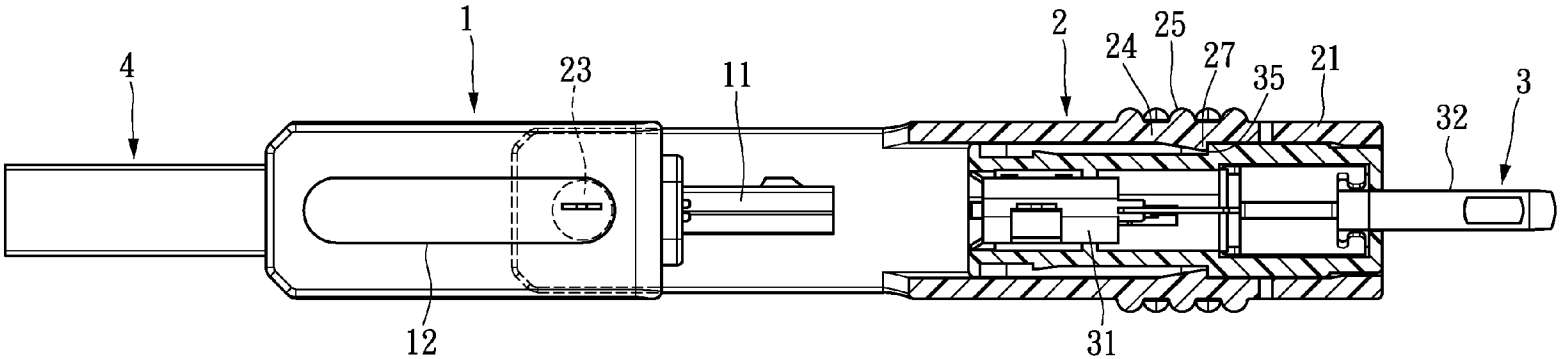
FIG. 14 shows a cross-sectional diagram (2) of a first embodiment of a connecting device of the present disclosure.

As shown in FIG. 3 and FIG. 13, the pivot parts 23 of the protective sleeve 2 can slide to the rear end of the sliding grooves 12 of the first connector 1, cause the sheath 21 of the protective sleeve 2 to sleeve the plugging portion 11 of the first plug 1, and protect the first connector 1 by shielding its two sides with the link arms 22 of the protective sleeve 2. The pivot parts 23 of the protective sleeve 2 can also slide to the front end of the sliding groove 12 of the first connector 1 (as shown in FIG. 14), and then turn the protective sleeve 2 in a different direction such that the plugging portion 11 of the first connector 1 is exposed available for plugging into docking connectors.

As shown in FIG. 1 to FIG. 3, the connecting device of the present disclosure can further include an adapter 3, which has a second connector 31 and a third connector 32 electrically connected to each other by a circuit board 33 or other suitable conducting elements. The type and structure of the second connector 31 and the third connector 32 are not limited, and can be an USB connector, an IEEE1394 connector, an HDMI connector, a display port connector, an RJ connector, an AV terminal, a DC terminal, an iphone connector, or other types of connectors. The second connector 31 and the first connector 1 are corresponding electrical connectors. An outer case 34 can cover the second connector 31 and the third connector 32.

The second connector 32 and the first connector 1 are selectively mated to achieve electrical connection. When the second connector 31 and the first connector 1 are plugged to each other, the adapter 3 can be electrically connected to the first connector 1 such that the first connector 1 can be connected to a dock connector through the third connector 32 of the adapter 3. As shown in FIG. 3 and FIG. 13, the pivot parts 23 of the protective sleeve 2 can slide to the rear ends of the sliding grooves 12 of the first connector 1, such that the third connector 32 is exposed from the sheath 21 of the protective sleeve 2, for plugging into a dock connector. The pivot parts 23 of the protective sleeve 2 can also slide to the front ends of the sliding grooves 12 of the first connector 1 (not shown in the figure), such that the third connector 32 is housed within the sheath 21 of the protective sleeve 2 for protecting the third connector 32.

Pressing parts 24 which are flexible in a vertical direction can be disposed on the top and bottom portions of the sheath 21 of the protective sleeve 2. In the present embodiment, the perimeters of the pressing parts 24 each form a U shaped indentation 241, such that the pressing parts 24 can form a sheet body which are flexible in a vertical direction. An uneven anti-slipping surface 25 is disposed on the outer side of each of the pressing parts 24. When the user wants to separate the adapter 3 from the first connector 1, he can press his fingers on the two pressing parts 24 on the sheath 21. The interior sides of the two pressing parts 24 abut the top and bottom of the adapter 3, such that the two pressing parts 24 grip the connector 3 so that the protective sleeve 2 and the adapter 3 can move in concert. In this manner the protective sleeve 2 and the adapter 3 can be moved further away from the first connector 1, such that the second connector 31 of the adapter 3 separates from the first connector 1 (as shown in FIG. 14).

The interior sides of the two pressing parts 24 selectively abut the top and bottom of the adapter 3. Engagement structures 27 and 35 can also be disposed between the interior sides of the two pressing parts 24 and the top and bottom of connector 3, such that when the pressing parts 24 are being pressed, the engagement structures 27 and 35 can mutually engage so that the interior sides of the pressing parts 24 can abut the top and bottom of the adapter 3 more securely.

Second Embodiment

Figure 4:
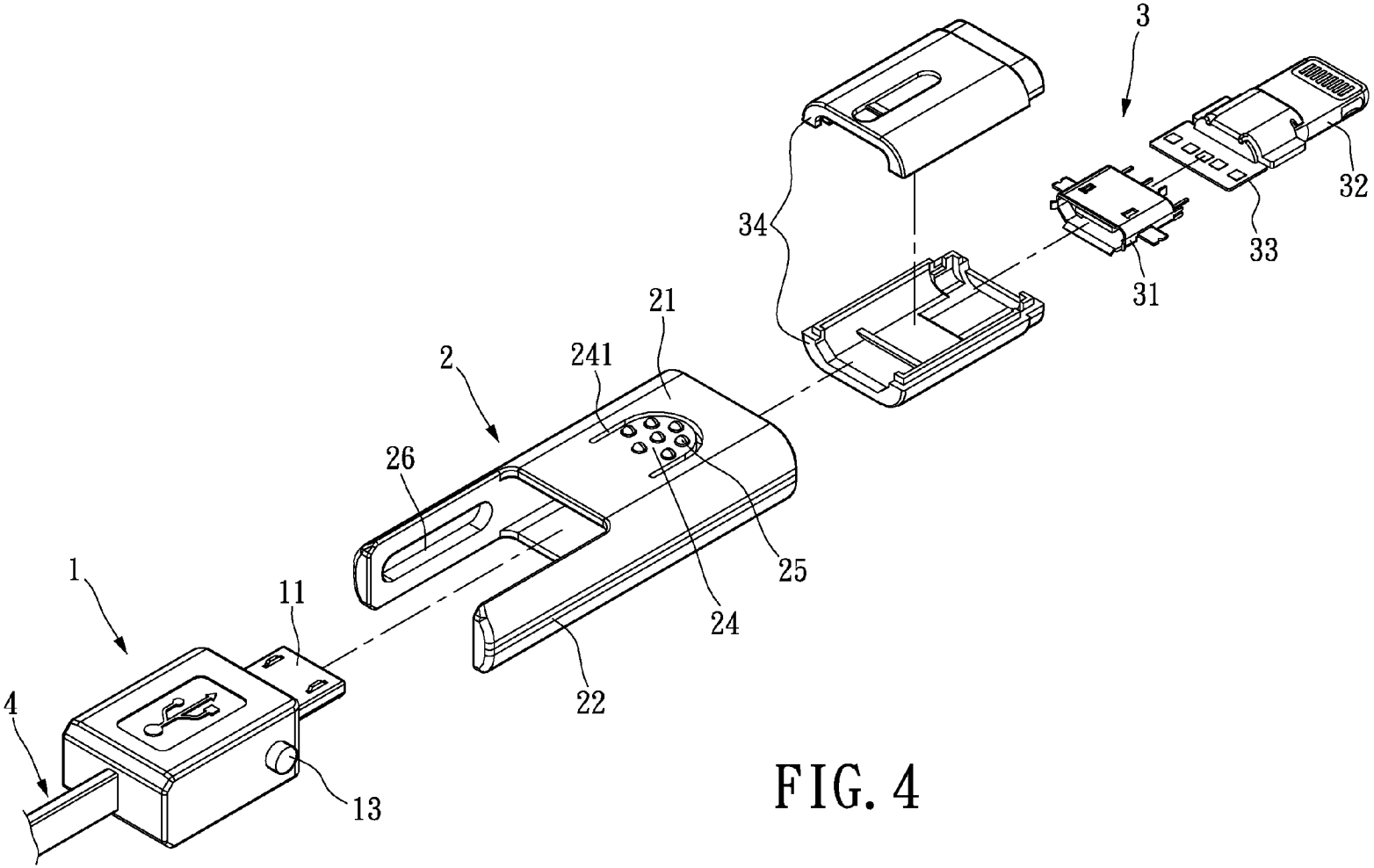
FIG. 4 shows a perspective exploded diagram of a second embodiment of a connecting device of the present disclosure.

Referring to FIG. 4, the interior sides of the two link arms 22 of the protective sleeve 2 respectively have sliding grooves 26. Pivot parts 13 corresponding to the sliding grooves 26 are formed on two sides of the first connector 1. The sliding grooves 26 of the protective sleeve 2 and the pivot parts 13 of the first connector 1 slidably work in concert, such that the first connector 1 can move between the two link arms 22 and turn in different directions. The method of operation and effect of the present embodiment are generally similar to those of the previous embodiment and therefore are not further detailed herein.

Third Embodiment

Figure 5:
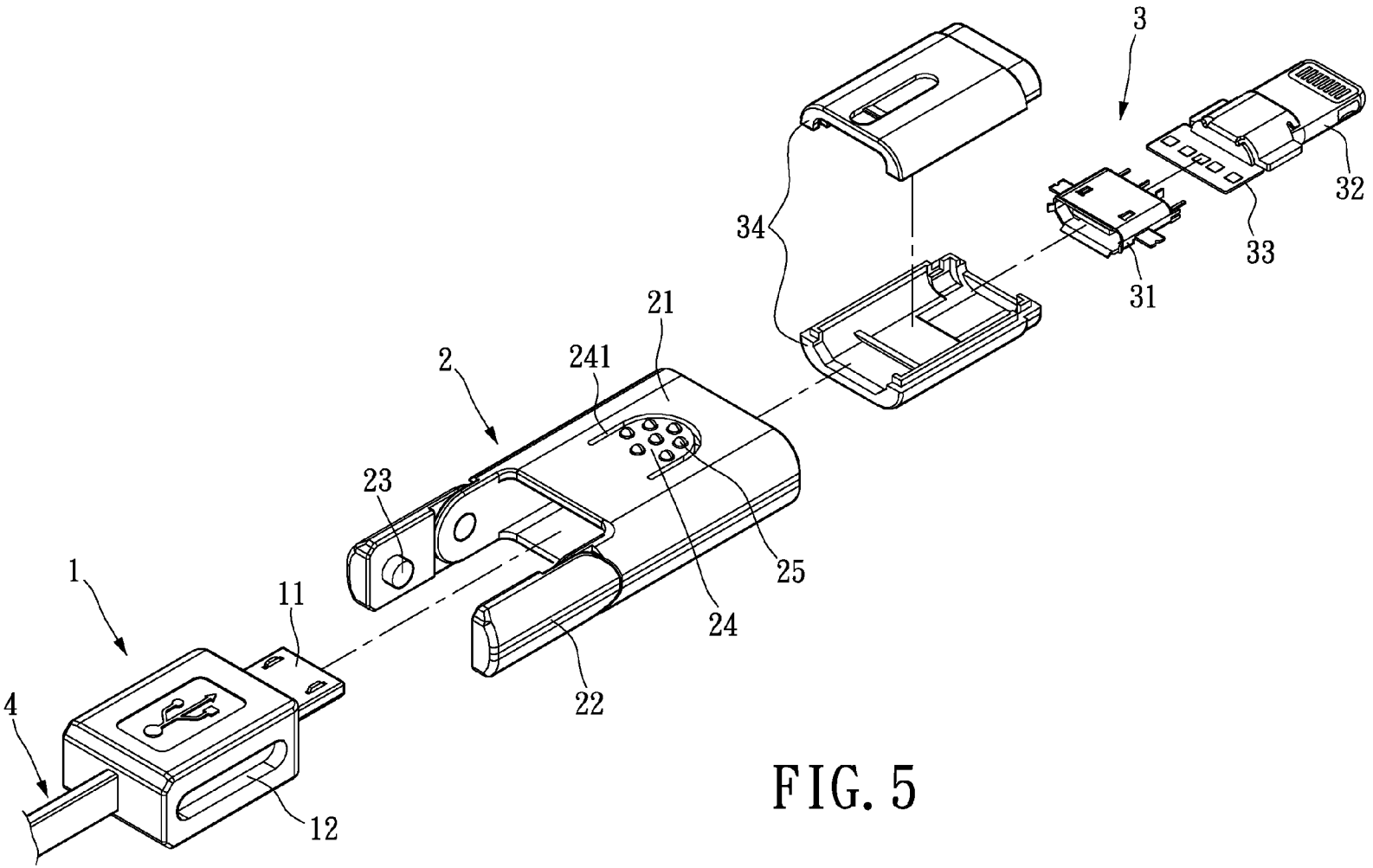
FIG. 5 shows a perspective exploded diagram of a third embodiment of a connecting device of the present disclosure.

Referring to FIG. 5, the two link arms 22 of the present embodiment are pivotally connected to the sheath 21. In other words, the two link arms 22 can rotate about the sheath 21.

Fourth Embodiment

Figure 6:
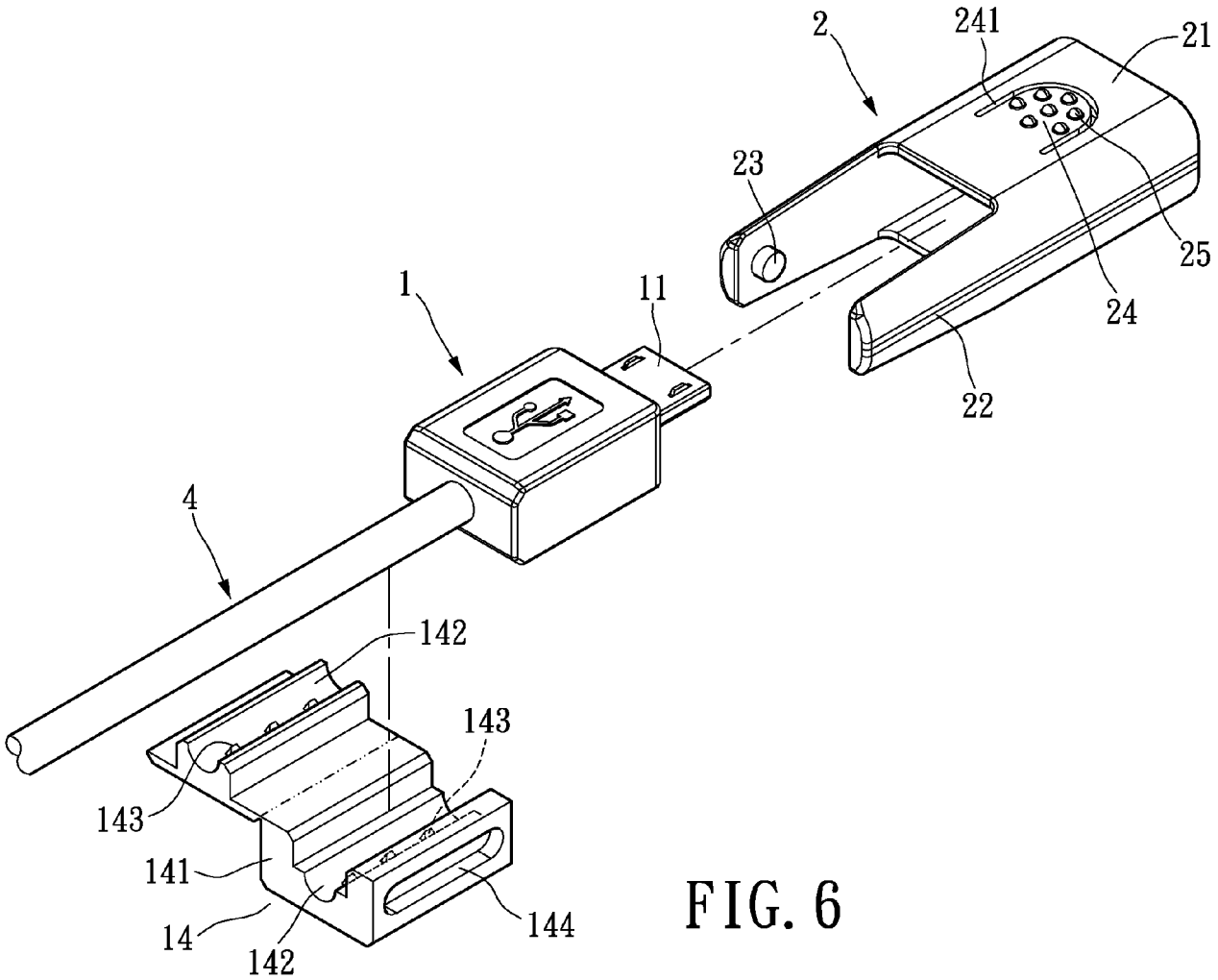
FIG. 6 shows a perspective exploded diagram of a fourth embodiment of a connecting device of the present disclosure.
Figure 7:
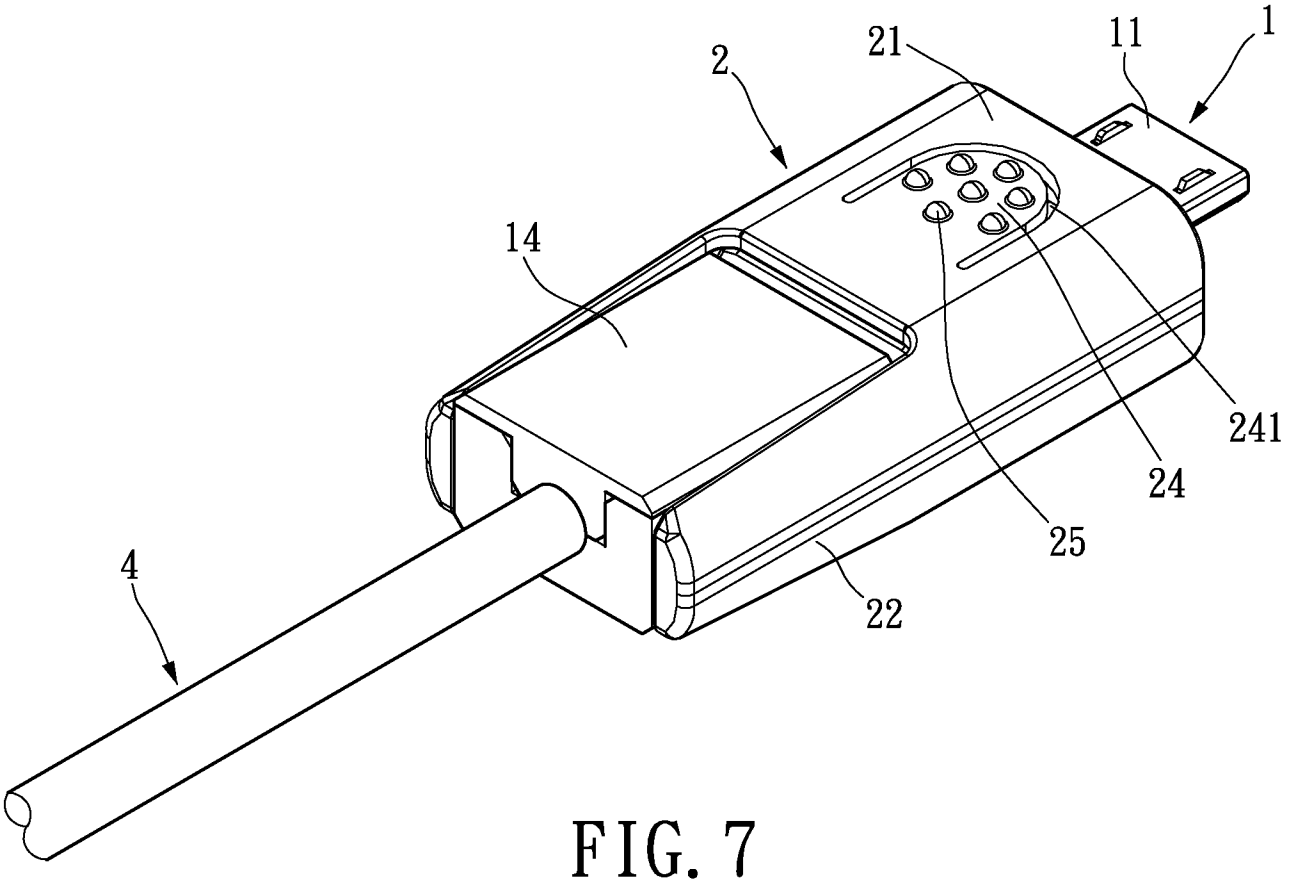
FIG. 7 shows a perspective diagram of a fourth embodiment of a connecting device of the present disclosure.

Referring to FIG. 6 and FIG. 7, the connecting device of the present embodiment includes a first connector 1 and a protective sleeve 2. The main difference of the present embodiment lies in that a cable clasp 14 is disposed on the rear end of the first connector 1 and fixed onto the cable 4. The structure and method of fixture of the cable clasp 14 is not limited herein. In the present embodiment, the cable clasp 14 has two connected covers 141. The two adjacent faces on the two covers 141 each have a cable groove 142 disposed thereon. A plurality of protruding impeding parts 143 can be disposed on the interior walls of the cable grooves 142. The two covers 141 of the cable clasp 14 can be closed upon each other, thereafter fixed by locking or gluing. The cable clasp 14 fixedly clasps the cable 4 on the rear end of the first connector 1, such that the cable 4 is accommodated between the grooves 142 of the two covers 141, and uses the impeding parts 143 to grasp the cable 4 such that the cable clasp 14 firmly clasps the cable 4.

Sliding grooves 144 are respectively formed on two sides of the cable clasp 14. The pivot parts 23 of the protective sleeve 2 and the sliding grooves 144 of the cable clasp 14 slidably work in concert such that the protective sleeve 2 can be movably coupled to the first connector 1, and the first connector 1 can move between the two link arms 22 and turn in different directions.

The pivot parts 23 of the protective sleeve 2 can slide to the front ends of the sliding grooves 144 of the cable clasp 14 (not shown in the figure), in order to facilitate the sheath 21 of the protective sleeve 2 to sleeve the plugging portion 11 of the first connector. The pivot parts 23 of the protective sleeve 2 can also slide to the rear ends of the sliding grooves 144 of the cable clasp 14 (as shown in FIG. 7), such that the plugging portion 11 of the first connector 1 is exposed, for plugging into a dock connector.

Fifth Embodiment

Figure 8:
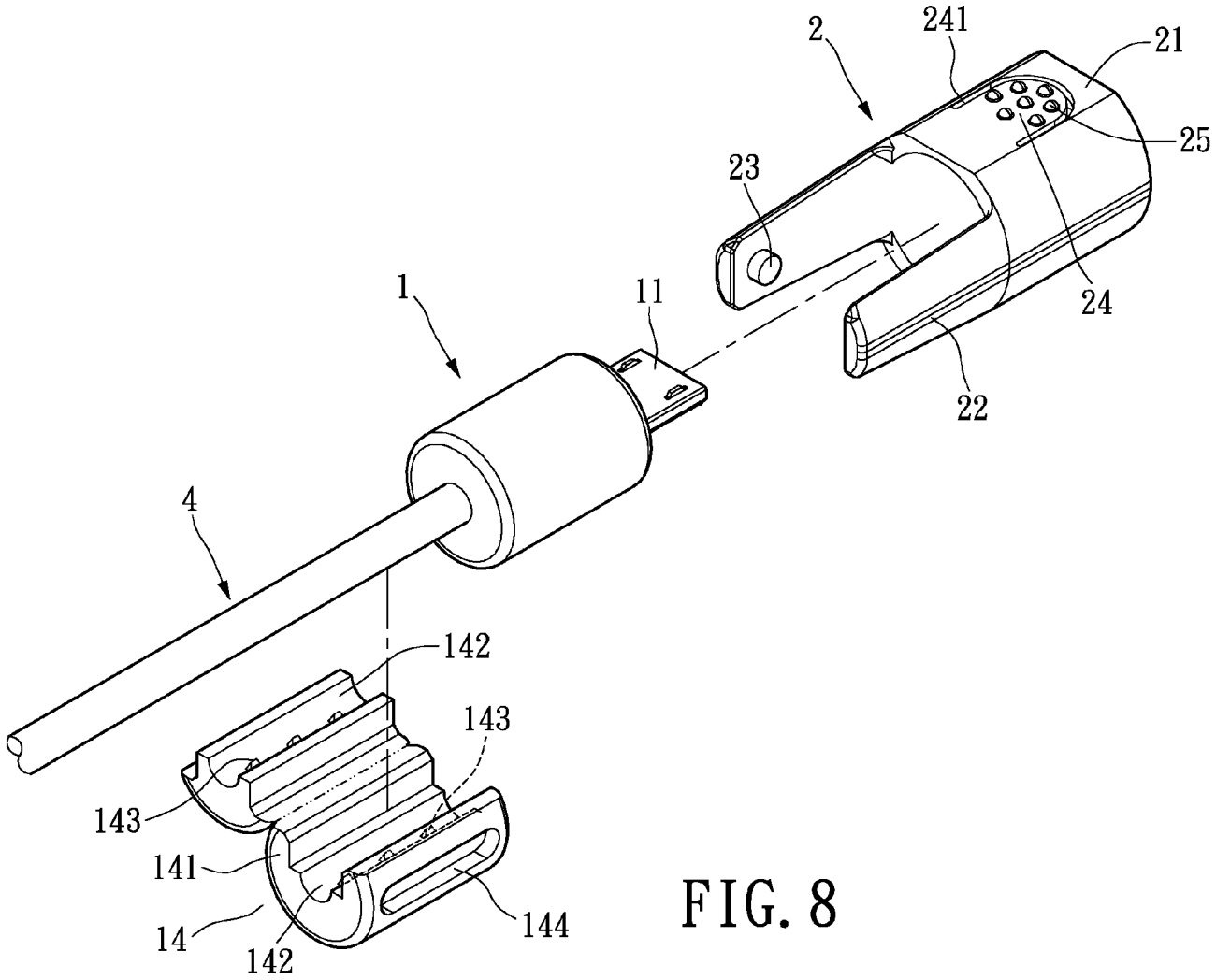
FIG. 8 shows a perspective exploded diagram of a fifth embodiment of a connecting device of the present disclosure.
Figure 9:
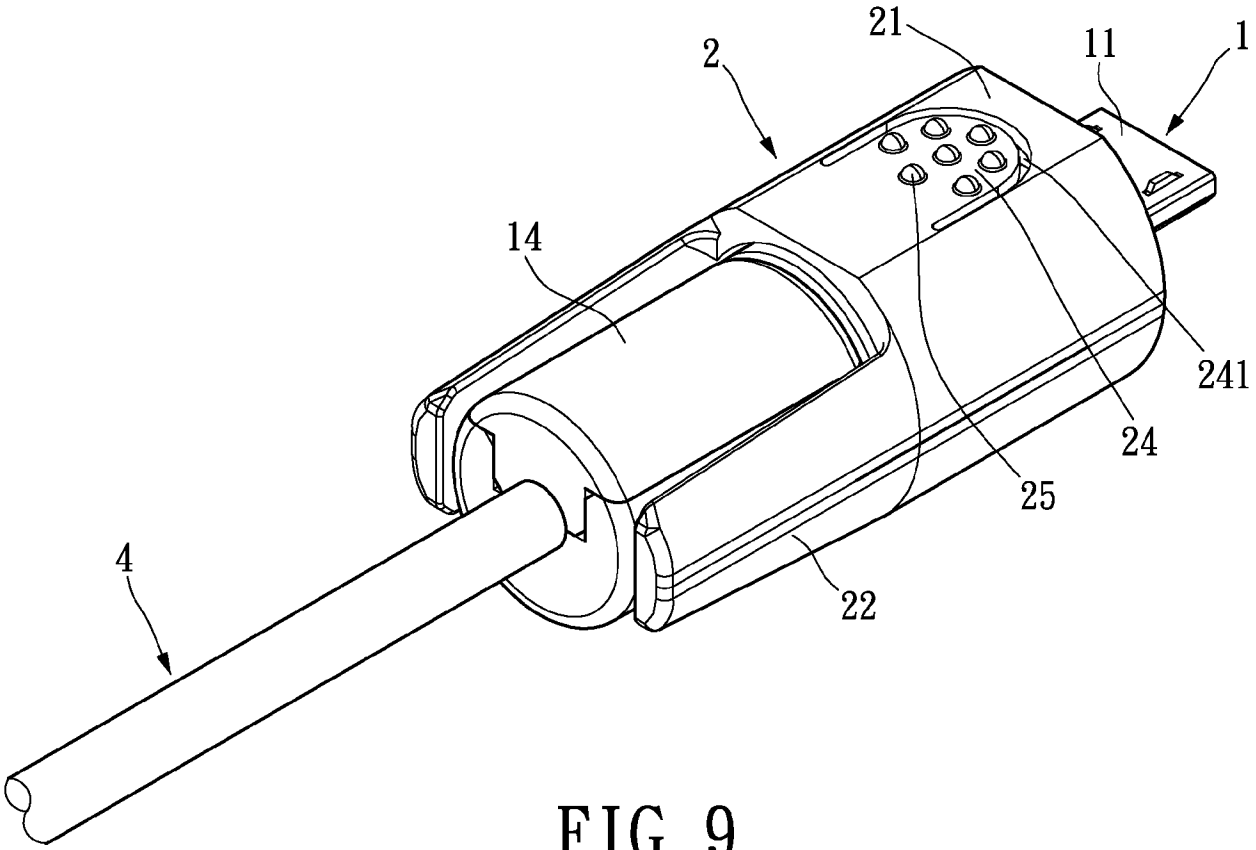
FIG. 9 shows a perspective diagram of a fifth embodiment of a connecting device of the present disclosure.

Referring to FIG. 8 and FIG. 9, the connecting device of the present embodiment includes a first connector 1 and a protective sleeve 2. The main difference of the present embodiment lies in that the appearances of the first connector 1 and the protective sleeve 2 are slightly modified. The method of operation and effect of the present embodiment are generally similar to those of the previous embodiment and therefore are not detailed further herein.

Sixth Embodiment

Figure 10:
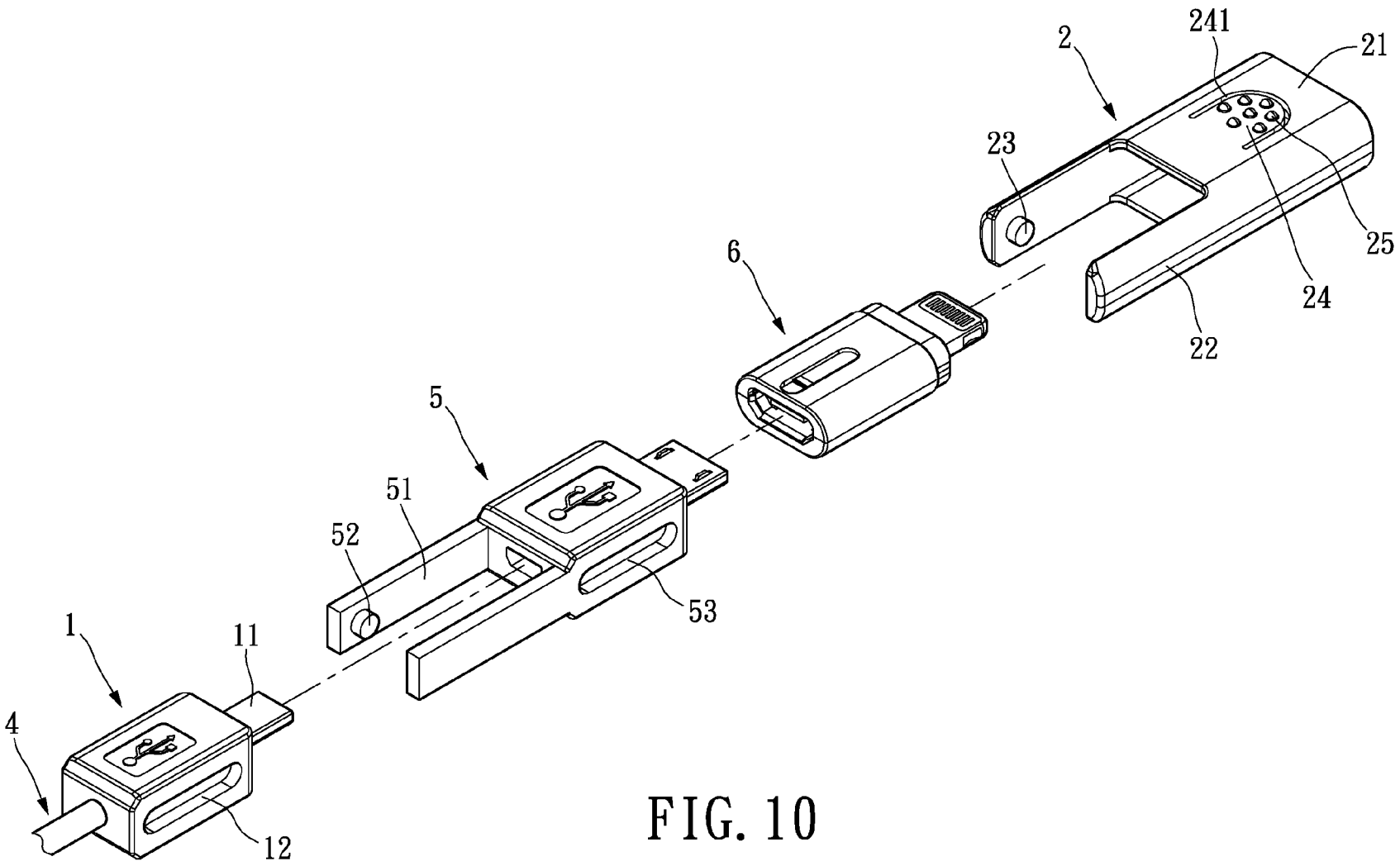
FIG. 10 shows a perspective exploded diagram of a sixth embodiment of a connecting device of the present disclosure.

Referring to FIG. 10, the first connector 1 of the present embodiment further connects to two adapters 5 and 6 which can be considered a connecting device. The adapters 5 and 6 each have two connectors electrically connected to each other (not shown in the figure). The first connector 1 mates with the two adapters 5 and 6 to achieve electrical connection. The adapter 5 has two link arms 51, the interior sides of which have pivot parts 52 formed thereon. The two pivot parts 52 and the sliding grooves 12 on two sides of the first connector 1 slidably work in concert. The two pivot parts 23 of the protective sleeve 2 and the sliding grooves 53 on two sides of the adapter 5 slidably work in concert, such that the protective sleeve 2 can be movably coupled to the adapter 5. The sheath 21 of the protective sleeve 2 selectively sleeves the adapter 5.

Seventh and Eighth Embodiments

Figure 12:
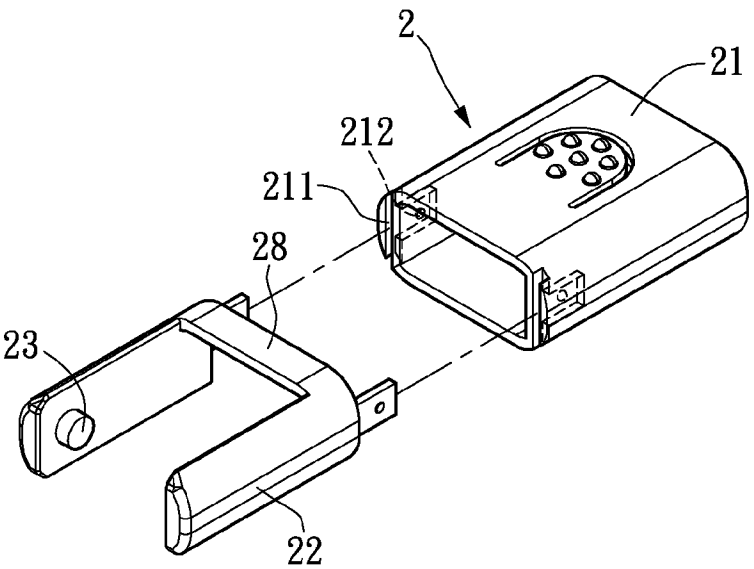
FIG. 12 shows a partial-structure perspective diagram of an eighth embodiment of a connecting device of the present disclosure.
Figure 11:
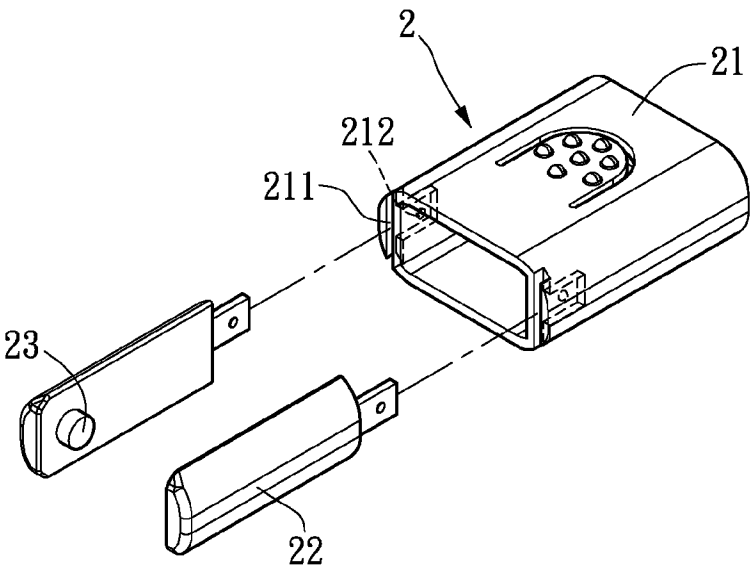
FIG. 11 shows a partial structural perspective diagram of a seventh embodiment of a connecting device of the present disclosure.

Referring to FIG. 11 and FIG. 12, one end on each of the two link arms 22 of the present embodiment is fixedly plugged to the sheath 21. The two link arms 22 can be connected there-between by a connecting rod 28. One end on each of the two link arms 22 can be fixedly plugged to corresponding jacks 211 on the sheath 21. Retaining parts 212 can protrude from the interior walls of the jacks 211 for retaining link arms 22.

Ninth Embodiment

Figure 15:
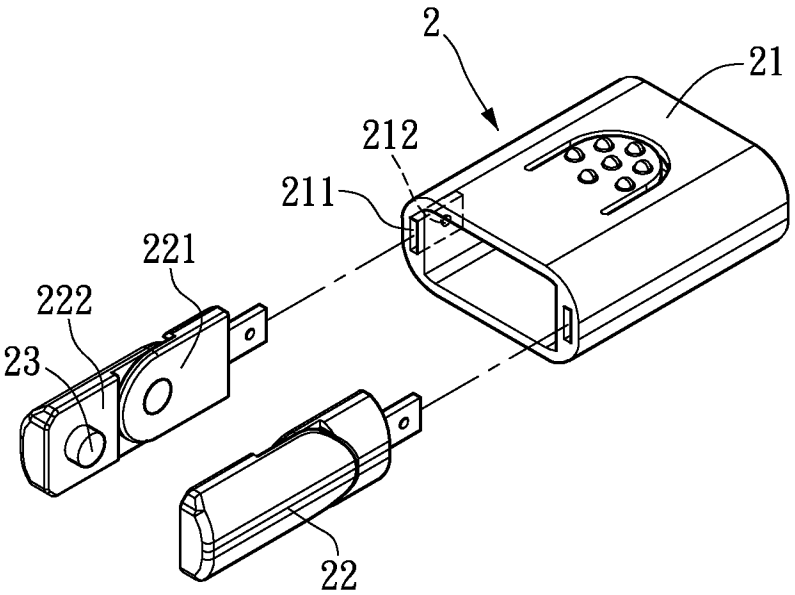
FIG. 15 shows a partial-structure perspective diagram of a ninth embodiment of a connecting device of the present disclosure.

Referring to FIG. 15, the link arms 22 of the present embodiment each have a first section 221 and a second section 222 connected to each other, such that the two link arms 22 of the protective sleeve 2 can bend in different angles.

The protective sleeve of the present disclosure can be movably coupled to the first connector. The sheath of the protective sleeve selectively sleeves the first connector, for protecting the plugging portion of the first connector in order to prevent the first connector from damaging or being damaged by other objects. For example, when the first connector is not in use, the protective sleeve can sleeve the first connector such that the first connector can be better protected, preventing the first protector from being scratched and damaged by other objects. The protective sleeve sleeved on the first connector also prevents the first connector from catching and damaging other objects.

The descriptions illustrated supra set forth simply the preferred embodiments of the present invention; however, the characteristics of the present invention are by no means restricted thereto. All changes, alternations, or modifications conveniently considered by those skilled in the art are deemed to be encompassed within the scope of the present invention delineated by the following claims.

What is claimed is:

1. An assembled connecting device, comprising:

a first connector, including a plugging portion;

a protective sleeve, including a sheath movably coupled to the first connector and selectively enveloping the first connector; and an adapter including a second connector and a third connector, the second connector and the third connector electrically connected, the second connector selectively electrically connected to the first connector, and the third connector exposed from the sheath of the protective sleeve or housed within the sheath of the protective sleeve.

2. The assembled connecting device according to claim 1, wherein the sheath of the protective sleeve selectively sleeves at least a portion of the first connector.

3. The assembled connecting device according to claim 1, wherein the sheath of the protective sleeve selectively sleeves the plugging portion of the first connector.

4. The assembled connecting device according to claim 1, wherein the protective sleeve has two link arms, the interior sides of the two link arms have pivot parts, two sides of the first connector have sliding grooves, and the two pivot parts and the sliding grooves on two sides of the first connector are slidably coupled.

5. The assembled connecting device according to claim 4, wherein the two link arms are fixedly or pivotally connected to the sheath.

6. The assembled connecting device according to claim 4, wherein one end on each of the two link arms is fixed by plugging to the sheath.

7. The assembled connecting device according to claim 1, wherein the protective sleeve has two link arms, the interior sides of the two link arms respectively have sliding grooves, the two sides of the first connector have pivot parts, and the two sliding grooves and the pivot parts on two sides of the first connector are slidably coupled.

8. The assembled connecting device according to claim 7, wherein the two link arms are fixedly or pivotally connected to the sheath.

9. The assembled connecting device according to claim 7, wherein one end on each of the two link arms is fixed by plugging to the sheath.

10. The assembled connecting device according to claim 1, wherein the top and bottom portions of the sheath of the protective sleeve have pressing parts, and the pressing parts are flexible in a vertical direction.

11. The assembled connecting device according to claim 10, wherein each of the outer surfaces of the two pressing parts has an anti-slipping surface.

12. The assembled connecting device according to claim 10, wherein the interior sides of the two pressing parts and the top and bottom of portions of the adapter have engagement structures engaged to each other there-between.

13. The assembled connecting device according to claim 1, wherein the first connector is electrically connected to a cable, the rear end of the first connector has a cable clasp fixed on the cable, two sides of the cable clasp have sliding grooves, the protective sleeve has two link arms, the interior sides of the two link arms respectively have pivot parts, and the pivot parts of the two link arms and the sliding grooves on two sides of the cable clasp are slidably coupled.

14. The assembled connecting device according to claim 13, wherein the cable clasp has two covers connected to each other, two contacting faces on the two covers each have a cable groove, the interior walls of the cable grooves have impeding parts, the two covers of the cable clasp close upon each other on the cable at the rear end of the first connector, the cable is received by the cable grooves of the two covers, and the impeding parts grasp the cable.

15. The assembled connecting device according to claim 1, wherein the first connector is electrically connected to a cable, the rear end of the first connector has a cable clasp, the cable clasp is fixed on the cable, two sides of the cable clasp have pivot parts, the protective sleeve has two link arms, the interior sides of the two link arms have sliding grooves, and the sliding grooves of the two link arms and the pivot parts on two sides of the cable clasp are slidably coupled.

16. The assembled connecting device according to claim 1, wherein the cable clasp has two covers connected to each other, two contacting faces on the two covers each have a cable groove, the interior walls of the cable grooves have impeding parts, the two covers of the cable clasp close upon each other on the cable at the rear end of the first connector, the cable is received by the cable grooves of the two covers, and the impeding parts grasp the cable.

* * * * *